United States Patent [19]

Hergert et al.

[11] 4,125,429

[45] Nov. 14, 1978

[54] HEADBOX TURBULENCE GENERATOR AND DAMPING SHEET

[75] Inventors: Richard E. Hergert, Rockton, Ill.; Charles L. Sanford, Beloit, Wis.

[73] Assignee: Beloit Corporation, Beloit, Wis.

[21] Appl. No.: 775,451

[22] Filed: Mar. 8, 1977

[51] Int. Cl.[2] ..... D21F 1/02

[52] U.S. Cl. ..... 162/123; 162/214; 162/216; 162/317; 162/343; 162/344; 162/347

[58] Field of Search ..... 162/123, 212, 214, 216, 162/298, 299, 317, 336, 341, 343, 344, 347

[56] References Cited

U.S. PATENT DOCUMENTS

| | | | |
|---|---|---|---|
| 3,802,960 | 4/1974 | Spengos | 162/216 |
| 3,937,273 | 2/1976 | Radvan et al. | 162/212 |
| 4,021,296 | 5/1977 | Reiner | 162/214 |

FOREIGN PATENT DOCUMENTS

| | | | |
|---|---|---|---|
| 808,931 | 3/1969 | Canada | 162/343 |

*Primary Examiner*—Richard V. Fisher

*Attorney, Agent, or Firm*—Hill, Gross, Simpson, Van Santen, Steadman, Chiara & Simpson

[57] ABSTRACT

Turbulence is generated within a headbox nozzle passage in such close adjacency to the slice opening as to assure thorough and substantially uniform dispersion of the fibers in a jet stream delivered to the forming area on a travelling paper web forming surface. Substantial suppression of turbulence in the jet stream is effected without interferring with the substantial uniformity of fiber dispersion in the suspension as delivered to the forming surface.

17 Claims, 5 Drawing Figures

HEADBOX TURBULENCE GENERATOR AND DAMPING SHEET

This invention relates to the art of papermaking, and is more particularly concerned with a new and improved method of and means for making paper with high consistency fiberous suspensions, that is, stock slurries.

Heretofore excellent means have been provided in the headbox nozzle passages for generating turbulence in high consistency fiber suspensions, commonly referring to as stock slurries. By way of example U.S. Pat. No. 3,309,264 is referred to. In that patent the turbulence generating means are located a substantial distance upstream from the slice opening, with a substantially smooth final outlet channel portion for affording partial decay of turbulence within the slurry before it emerges from the slice opening as a jet stream onto the forming area of a travelling paper web forming surface. To any extent necessary, the disclosure of said U.S. Pat. No. 3,309,264 is incorporated herein by reference to avoid the necessity of elaborating upon the papermaking techniques and the desirability of the turbulence generating means, all of which have been thoroughly discussed in the patent disclosure. At the time of that patent it was thought necessary to permit at least partial decay of turbulence before issuing the jet stream so as to avoid turbulence in the jet stream and particularly at the free or upper surface of the relatively wide band jet stream.

However, with at least some types of papermaking fiber suspensions, which may be in a concentration of from 3 to 6%, there is such dispersion decay and deterioration in the interval between turbulence generation and the slice opening that substantial refloccing of the fibers occurs in the channel preceding the slice opening, resulting in a blotchy and grainy looking sheet instead of the smooth, uniform quality desired. Hence, the problem to be overcome, and to which the present invention is addressed, is to avoid dispersion decay and deterioration and maintain substantially uniform fiber dispersion decay and deterioration and maintain substantially uniform fiber dispersion continuously into the forming area.

Accordingly an important object of the present invention is to maintain substantially uniform fiber dispersion of papermaking fiber suspensions from the turbulence generators in headbox nozzles continuously into the forming areas on travelling paper web forming surfaces, particularly in papermaking utilizing high consistency fiber suspensions.

Another object of the invention is to provide new and improved means for attaining the desired results.

A further object of the invention is to provide a new and improved method for attaining the desired results.

According to features of the present invention, there is provided a method of papermaking comprising issuing a jet stream of fiber suspension from a substantially rigidly defined slice opening leading from a headbox nozzle passage and delivering the stream to a generally upwardly facing forming area on a travelling paper web forming surface, generating turbulence in the suspension in the nozzle passage in such close adjacency to the slice opening as to substantially avoid turbulence decay upstream from the slice opening and thereby assuring thorough and substantially uniform dispersion of the fibers in the jet stream, and after the jet stream has left the slice opening and is carried on said forming area superimposing in freely lying relation on the jet stream over said forming area a turbulence damping sheet which is self-adjustably flexible substantially throughout its length and extends downstream from said slice opening and thereby substantially suppressing turbulence in the jet stream without interferring with the substantial uniformity of fiber dispersion in the suspension as delivered to the forming surface.

According to other features of the invention, there is provided in papermaking machine apparatus means defining a headbox nozzle passage terminating in a substantially rigidly defined slice opening of a desired width to issue a jet stream of papermaking fiber suspension to a generally upwardly facing forming area on a travelling paper web forming surface, turbulence generating means in the passage in such close adjacency to the slice opening as to substantially avoid turbulence decay upstream from the slice opening and thereby assuring thorough and substantially uniform dispersion of the fibers in the jet stream, and means comprising a turbulence damping sheet which is self-adjustably flexible substantially throughout its length extending downstream from said slice opening and arranged to lie freely superimposed on the jet stream over said forming area for substantially suppressing turbulence in the jet stream without interferring with the substantial uniformity of fiber dispersion in the suspension as delivered to the forming surface.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure, and in which.

Figure 1:
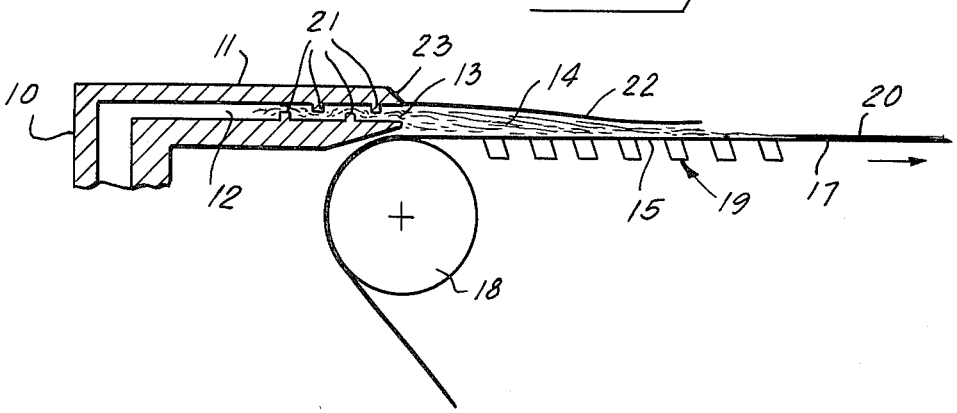
FIG. 1 is a schematic side elevational, partially sectional view representing one preferred form of apparatus embodying features of the invention and by means of which the method of the present invention can be practiced.

On reference to FIG. 1, a headbox 10 has a nozzle structure 11 within which there is a nozzle passage 12 terminating in a slice opening 13 of a desired width to issue a jet stream 14 of papermaking fiber suspension to a forming area 15 on a travelling web forming surface 17. In a customary form, the forming surface 17 comprises a forming wire driven to travel at a suitable lineal velocity which may be on the order of 3000 ft. per minute with the jet stream 14 delivering to the forming area 15 at about 50 ft. per second. The width of the forming wire 17 will be as great as desired for the particular paper web to be formed, and the width of the slice opening 13 will be proportionate. At the upstream end of the forming area 15, the travelling forming web 17 runs over a roll 18 which may be a suction couch roll. In addition, or alternatively, a wet suction box 19 or foils may underlie the forming area 15. In any event, the arrangement is such that the fiber slurry delivered in the jet stream 14 will be rapidly dewatered and a resulting web 20 carried onward by the forming surface wire 17.

Paper stock of suitable consistency, and which may be of a high consistency of from 3 to 6% fiber, is supplied through the headbox 10 from a suitable source and by way of the passage 12 to the slice opening 13 to issue therefrom at the desired velocity. In order to assure substantially uniform dispersion of the fibers in the jet-stream, the nozzle passage 12 is substantially free from turbulence decay in the channel area of the passage immediately upstream from the slice opening 13 and turbulence is generated in the suspension in the nozzle passage in such close adjacency to the slice opening 13 that deterioration due to reflocculation will be prevented at any point short of the forming area on the forming surface. To this end turbulence generating means 21 are provided in the delivery terminal channel portion of the passage 12 terminating in the slice opening 13. In one preferred form, as shown, the turbulence means 21 comprise alternately opposite spaced ribs extending across the passage 12 providing, in effect, opposed complementary riffles having a thoroughly agitating, turbulence generating effect on the stock driven through the turbulence generator and carrying over immediately to the slice opening 13 and persisting in the jet stream 14. As will be apparent, the turbulence means 21, e.g., rib/riffles, are substantially spaced lengthwise along the passage 12 and provide with the opposing walls defining the passage alternate constrictions causing a turbulence in the fiber suspension of the stock flowing through the passage.

Means are provided for substantially suppressing turbulence in the jet stream without interferring with the substantial uniformity of fiber dispersion in the suspension as delivered to the forming surface 17 in the forming area 15. For this purpose a flexible turbulence suppressor or damping sheet 22 extends downstream from the tip of the nozzle 11 superposed on the flat jet stream 14. The sheet 22 is of sufficient length to assure turbulence suppression throughout the length of the jet stream until drainage of the web forming stock in the forming area 15 has removed sufficient carrying liquid from the stock to eliminate any need for turbulence suppression external to the rapidly, felting web-forming consolidation of the suspended fibers in the stream. In a preferred form, the turbulence suppressor sheet 22 comprises a piece of suitable plastic sheet material heavy enough to avoid whipping from impact of the jet stream 14, but light enough to avoid cramping the stream or interferring with smooth, uniform forming flow of the stream onto and with the forming surface 17 in the forming area 15. Sufficient flexibility is desirable in the suppressor sheet 22 substantially throughout its length to permit it to ride self-adjustably on the surface of the jet stream 14 opposite the forming surface 17 so as to maintain continuous turbulence suppressing, damping control upon the jet stream 14 at all times from machine startup to turn-off and during any fluctuations that may occur due to stock flow adjustments or otherwise. Although mounting of the turbulence suppressor sheet 22 may be effected in other suitable ways, it may satisfactorily be secured at its leading end 23 to that lip of the nozzle 11 which is remote from the forming surface 17, that is the upper lip as shown in FIG. 1, by any suitable means such a screws, clamping strip, or any other conventional means. Except for its anchorage at the leading end 23, the sheet 22 may be free floating.

Figure 2:
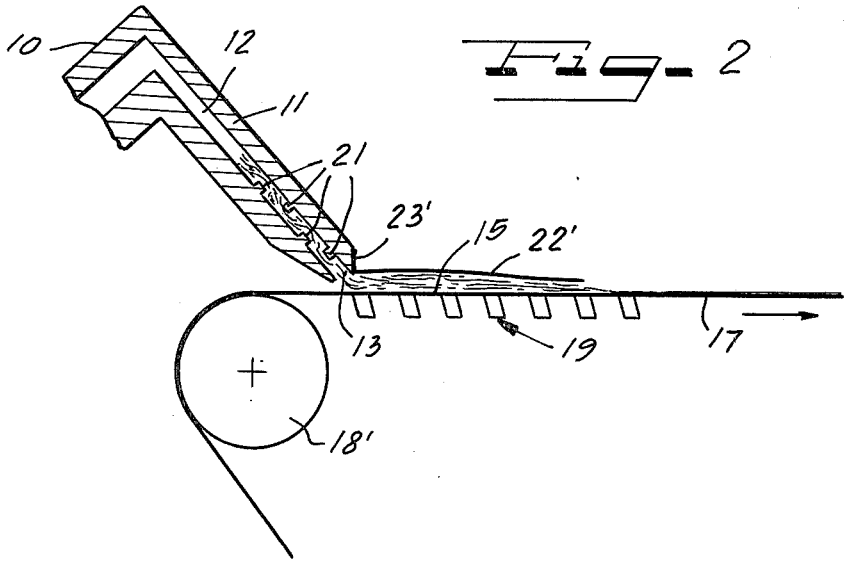
FIG. 2 is a similar schematic view showing a modification.

In FIG. 2, the roll 18' may be a simple imperforate breast roll over which the forming surface wire 17 is wrapped, and the headbox 10 is positioned to have the nozzle 11 directed to impinge the jet stream at an angle toward the forming area 15 after the web forming surface leaves the roll 18', but toward the upstream end of the suction box 19. The turbulence suppressor sheet 22' extends over the forming area 15 from the sheet attachment 23' to the tip of the nozzle 11 and effective to suppress turbulence generated by the turbulence generators 21 in the nozzle passage 12, and carrying over into the jet stream.

Figure 3:
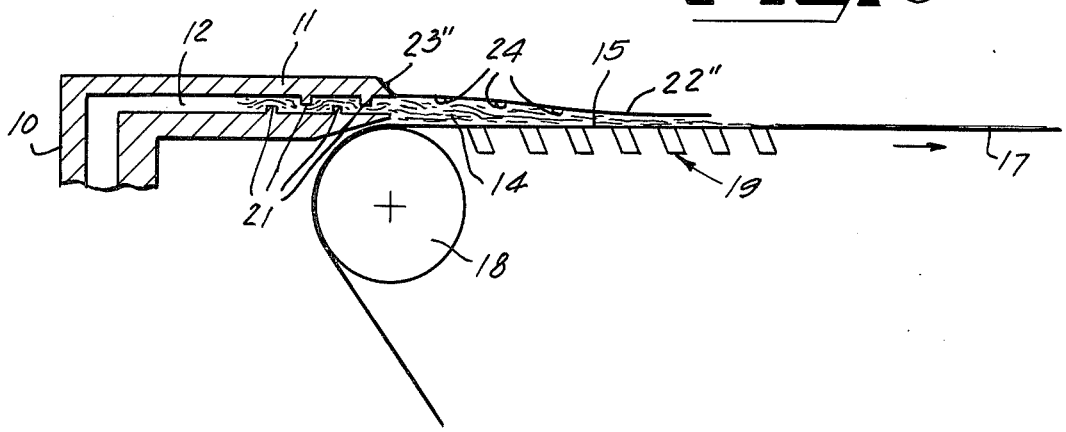
FIG. 3 is another similar schematic view showing another modification.

In the form of the invention depicted in FIG. 3, the structure and method of operation are substantially the same as described in connection with FIG. 1, except that in order to accommodate high consistency fiber stock which is unusually susceptible to reflocculation, the self-adjustably flexible turbulence suppressor sheet 22'' attached to the tip of the nozzle 11 at 23'' is equipped with jet stream surface turbulence generators 24 of lesser capacity than the generators 21 in the passage 12 but sufficient to maintain the surface of the jet stream 14 at the boundary layer with the sheet sufficiently agitated to avoid too rapid turbulence decay and thus tendency for the stock fibers to reflocculate before action of the suction box 19 has sufficiently drained the stock in the stream to assure uniformity of felting of the web-forming fibers. Thus, although the suppressor sheet 22'' acts to suppress the fairly high magnitude turbulence generated by the generators 21, the suppression is modulated sufficiently by the minor action suppressors 24 spaced longitudinally along the stream engaging surface of the sheet to maintain the substantial integrity of uniform dispersion of the fibers in the jet stream 14 against any tendency of accelerated reflocculation of the fibers in the stock before web felting has sufficiently advanced downstream along the forming area 15 to assure uniform felting of the fibers in the web.

Figure 4:
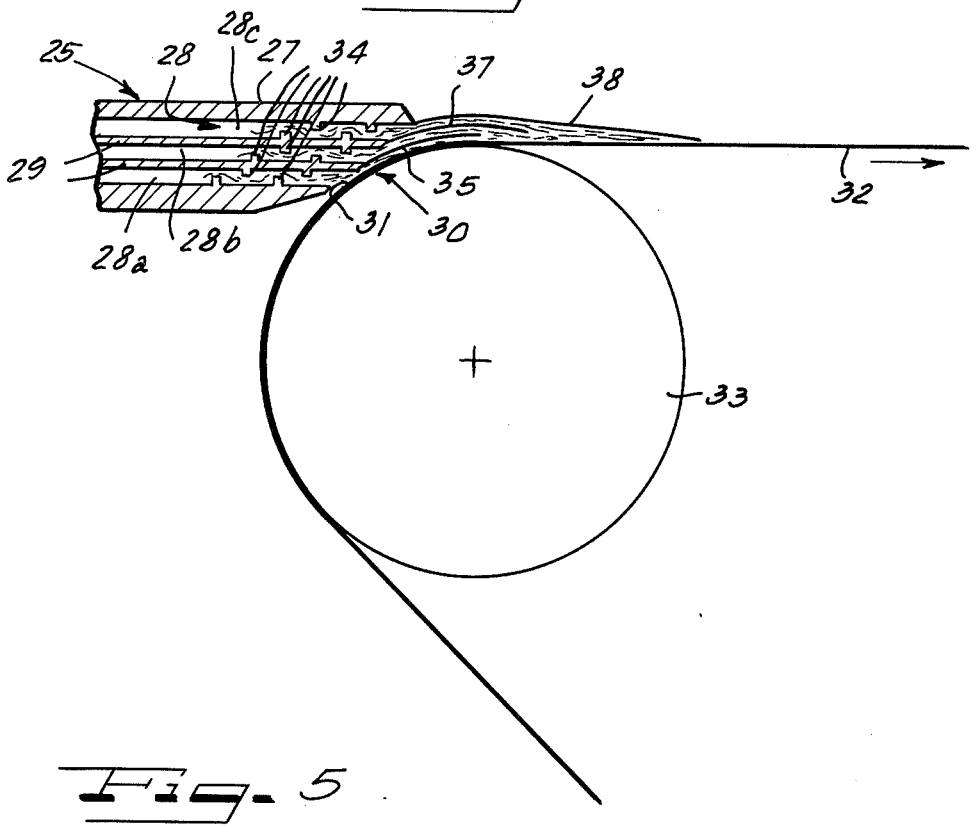
FIG. 4 is still another schematic view showing a modification enabling forming a multi-ply sheet.

For multi-ply formation, the apparatus and method envisioned in FIG. 4 may be utilized. Although the arrangement may be for producing a two-ply web, a three-ply arrangement has been depicted. However, if preferred a greater number of plies may be provided. To this end, a headbox 25 is provided with a delivery nozzle 27 having therein a paper stock fiber suspension delivery passage 28 sub-divided by partitions 29 into a plurality of sub-passages **28*a*, 28*b* and 28*c*. In this instance, the nozzle 27 has a substantially rigidly defined slice opening 30 generally contoured to at least in part direct the fiber stock jet streams from the subpassages 28*a*, 28*b* and 28*c* toward a forming area 31 on a forming surface 32 provided by means such as a forming wire wrapped to travel over a suction roll 33 and wherein at least part of the forming surface 31** conforms to the perimeter of a portion of the roll.

In a desirable arrangement, each of the sub-passages **28*a*, 28*b* and 28*c* is equipped as closely adjacent to the slice opening 30 as practicable with turbulence generating means 34 which may be substantially like the turbulence generating means of FIG. 1, comprising a plurality of alternate, opposite spaced turbulence generating ribs along the terminal portion of each of the sub-passages, substantially as shown. Although the jet streams from the several sub-passages leave the slice opening in a turbulent state such that there might be a tendency for the sub-streams to comingle and destroy integrity of the several plies to be formed in the web, by substantially suppressing turbulence in the succesive jet streams without interferring with the substantial uniformity of fiber dispersion in the suspension as delivered thereby to the forming surface 32 in the forming area 31, integrity is satisfactorily maintained in each of the plies. Therefore, as the sub-stream from the lower of the sub-passages 28 issues to the forming area 31, turbulence is substantially suppressed by means of a self-adjustably flexible suppressor sheet 35 anchored to the tip of the partition 29 defining the upper side of the sub-passage 28***a*, and extending sufficiently beyond the slice opening end of the superjacent sub-stream 21*b*, to avoid disturbance of the forming sub-stream from the passage 28*a*. At the same time, the jet sub-stream from the sub-passage 28*b* has its turbulence substantially suppressed by a self-adjustably flexible suppressor sheet 37 anchored at its leading end to the tip of the partition which defines the upper side of the sub-passage 21*b*, the sheet 37 extending sufficiently beyond the jet outlet from the uppermost sub-passage 28*c* to avoid interference by the turbulent jet stream from the sub-chamber 28*c* with the forming ply delivered from the sub-passage 28*b*. In turn turbulence in the sub-jet stream delivered from the upper sub-passage 28*c* substantially suppresed by means of a self-adjustably flexible suppressor sheet 38 which is anchored at its leading end to the tip of the uppermost portion of the nozzle 27, substantially as shown. Through this arrangement, thorough and substantially uniform dispersion in the suspension of each of the sub-streams as delivered to the forming surface 32 at the forming area 31 is assured, and is an especially valuable technique when forming high consistency fiber suspension into a multiply web.

Figure 5:
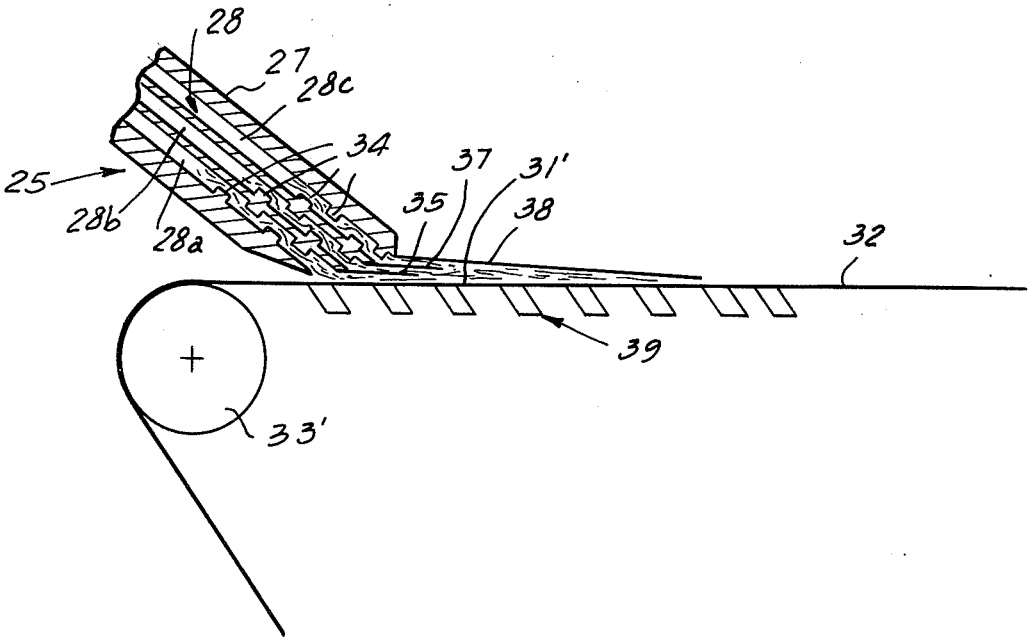
FIG. 5 is a similar schematic view showing another form of the apparatus for forming a multi-ply sheet.

In FIG. 5 the nozzle 27 is directed at an angle toward a forming area 31' on the forming surface 32 adjacently downstream relative to a guide roll 33', over which the wire providing the forming surface 32 is partially wrapped and from which the wire moves over a suction box 39 underlying the forming area 31'. As will be appreciated, the arrangement of FIG. 5 is similar to that described in connection with FIG. 2, except that in FIG. 5 the assembly provides for making a multi-ply web. Aside from the different orientation of the headbox nozzle 27 toward the forming area 31', operation of the device is substantially the same as described for the device of FIG. 4, including the function of the turbulence suppressor sheets 35, 37 and 38.

In all forms of the invention there is accomplished the substantial reduction in time from the turbulence generation in the fibrous stock suspension to the point where the suspension is drained and formed into a web sheet. Thereby, premature turbulence decay and possible reflocculation is prevented. At the same time, any disruptive influence that the active turbulence may be inclined to have in the jet stream directed toward the forming area of the web forming surface, is avoided by damping and suppressing the turbulence effect in the jet stream but in such a manner as to attain substantially full value of the turbulence effect is substantially uniform dispersion of the fiber suspension to the point where drainage in the forming area caused felting of the web.

It will be appreciated, of course, that the quite schematically illustrated headbox and nozzle structure may be equipped with any desirable structural features, some of which are well known such as adjustability of the slice opening thickness, tapered throat for the headbox nozzle opening, etc., while utilizing the principles of the present invention.

It will be understood that variations and modifications may be effected without departing from the spirit and scope of the novel concepts of this invention.

We claim as our invention:

1. A method of papermaking comprising:

issuing a jet stream of fiber suspension from a substantially rigidly defined slice opening leading from a headbox nozzle passage and delivering the stream to a generally upwardly facing forming area on a travelling paper web forming surface;

generating turbulence in the suspension in the nozzle passage in such close adjacency to the slice opening as to substantially avoid turbulence decay upstream from the slice opening and thereby assuring thorough and substantially uniform dispersion of the fibers in the jet stream;

and after the jet stream has left the slice opening and is carried on said forming area, superimposing in freely lying relation on the jet stream on said forming area a turbulence damping sheet which is self-adjustably flexible substantially throughout its length and extends downstream from said slice opening and thereby substantially suppressing turbulence in the jet stream without interferring with the substantial uniformity of fiber dispersion in the suspension as delivered to the forming surface.

2. A method of papermaking according to claim 1, comprising issuing a second jet stream of fiber suspension from the slice opening to the forming area in multiply relation to the first-mentioned jet stream, generating turbulence in the fiber suspension for said second jet stream, substantially suppressing turbulence in the second jet stream, and maintaining the jet streams separated for a substantial distance beyond the slice opening sufficient to avoid turbulence interference of one jet stream with the other jet stream.

3. A method of papermaking according to claim 1, which comprises issuing a plurality of jet streams of respective fiber suspensions, generating turbulence in each of the fiber suspensions adjacently upstream from the slice opening, and interposing between the jet streams flexibly self-adjustable combination separation and turbulence suppressor sheets extending from the slice opening and thus suppressing turbulence in the jet streams and maintaining the jet streams separated a sufficient distance beyond the slice opening to avoid interference of one jet stream with the other jet stream.

4. A method according to claim 1, including generating minor turbulence at the sheet boundary layer along the surface of the jet stream which is opposite to the surface of the jet stream which engages the forming area, and thereby avoiding premature turbulence decay along said opposite surface.

5. In papermaking machine apparatus;

means defining a headbox nozzle passage terminating in a substantially rigidly defined slice opening of a desired width to issue a jet stream of papermaking fiber suspension to a generally upwardly facing forming area on a travelling paper web forming surface;

turbulence generating means in said passage in such close adjacency to said slice opening as to substantially avoid turbulence decay upstream from the slice opening and thereby assuring thorough and substantially uniform dispersion of the fibers in the jet stream;

and means comprising a turbulence damping sheet which is self-adjustably flexible substantially throughout its length extending downstream from said slice opening and arranged to lie freely superimposed on the jet stream over said forming area for substantially suppressing turbulence in the jet stream without interferring with the substantial uniformity of fiber dispersion in the suspension as delivered to the forming surface.

6. Apparatus according to claim 5, wherein said slice opening is subdivided to issue a second jet stream to the forming area in multi-ply relation to the first mentioned jet stream, means for generating turbulence in the fiber suspension for said second jet stream, and means for substantially suppressing turbulence in the second jet stream and for maintaining the jet streams separated for a substantial distance beyond the slice opening sufficient to avoid turbulence interference of one jet stream with the other jet stream.

7. Apparatus according to claim 5, wherein said slice opening comprises means for issuing a plurality of jet streams of respective fiber suspensions from sub-passages in the headbox nozzle passage, means for generating turbulence in each of the fiber suspensions in the sub-passages adjacently upstream from the slice opening means, and flexibly self-adjustable combination separation and turbulence suppressor sheets extending from said slice opening means and interposed between the jet streams for suppressing turbulence in the jet streams and maintaining the jet streams separated a sufficient distance beyond the slice opening means to avoid interference of one jet stream with the other jet stream.

8. Apparatus according to claim 5, wherein said turbulence suppressing means comprise a flexible plastic sheet having a leading end anchored to said headbox nozzle passage defining means.

9. Apparatus according to claim 5, wherein said nozzle passage defining means include means subdividing the passage into a plurality of sub-passages, said sub-passages having respective jet outlets at said slice opening for issuing respective jet streams of papermaking fiber suspensions in multi-ply relation to said forming area, and said means for suppressing turbulence comprising combination turbulence damping and jet stream separating self-adjustably flexible sheet members.

10. Apparatus according to claim 9, wherein said combination damping and separating members comprise flexible plastic sheets.

11. Apparatus according to claim 9, wherein said jet outlets are oriented to deliver jet streams therefrom progressively to said forming area in the direction of the travelling forming surface, and said combination members comprise flexible sheets of staggered length whereby the sheet damping the jet stream reaching the forming area first is the shortest and the sheet damping the jet stream reaching the forming area last is the longest.

12. Apparatus according to claim 5, wherein said turbulence generating means comprise substantially spaced staggered elements projecting into the passage from opposite walls defining the passage and providing with said walls alternate constrictions causing a repeated turbulence of the stock flowing through the passage accompanied by repeated fiber-dispersing stock turbulence through the constrictions into expansion areas between the turbulence generating means elements.

13. Apparatus according to claim 12, wherein said elements comprise ribs extending across the passage.

14. Apparatus according to claim 5, including turbulence generating means carried on the stream engaging surface of the flexible sheet.

15. Apparatus according to claim 5, comprising minor turbulence sustaining generating means on said sheet to avoid premature turbulence decay along the surface of the jet stream opposite to the surface of the jet stream which makes contact with said forming area.

16. In a papermaking machine apparatus:

means defining a headbox nozzle passage terminating in a slice opening of a desired width to issue a jet stream of papermaking fiber suspension to a forming area of a travelling paper web forming surface; turbulence generating means in said passage to assure substantially uniform dispersion of the fibers in the jet stream;

said turbulence generating means comprising rib riffles alternately located on opposite walls defining said passage and providing with the opposing wall in each instance respective constrictions causing an undulating fiber dispersing turbulence of the stock flowing through the passage accompained by repeated fiber-dispersing stock turbulence surges through the constrictions into expansion areas between the rib riffles;

and means comprising a turbulence damping sheet which is self-adjustably flexible substantially throughout its length extending downstream from said slice opening and arranged to lie freely superimposed on the jet stream over said forming area for substantially suppressing turbulence in the jet stream without interferring with the substantial uniformity of fiber dispersion in the suspension as delivered to the forming surface.

17. Apparatus according to claim 16, including turbulence generating means carried on the stream engaging surface of the flexible sheet.

* * * * *